United States Patent [19]

Koenneman

[11] 4,402,303

[45] Sep. 6, 1983

[54] FAN FLOW CONTROL DEVICE

[76] Inventor: Donald E. Koenneman, 11264 W. Mexico Dr., Lakewood, Colo. 80226

[21] Appl. No.: 343,579

[22] Filed: Jan. 28, 1982

[51] Int. Cl.[3] ..... F23N 1/08; F23J 11/00

[52] U.S. Cl. ..... 126/307 A; 126/312; 110/162; 236/15 C

[58] Field of Search ..... 236/15 C; 110/123, 147, 110/163, 162; 126/307 A, 312

[56] References Cited

U.S. PATENT DOCUMENTS

| | | | |
|---|---|---|---|
| 1,358,854 | 11/1920 | Kendall | 110/163 |
| 2,303,894 | 12/1942 | Olsen | 236/15 C |
| 2,612,319 | 9/1952 | Wadenstein | 236/15 C |
| 2,847,952 | 8/1958 | McDonald | 110/165 |
| 3,964,675 | 6/1976 | Euchner, Jr. | 110/165 |
| 4,185,685 | 1/1980 | Giberson | 110/162 |
| 4,189,295 | 2/1980 | Ramon | 236/15 C |
| 4,245,569 | 1/1981 | Fallon | 110/162 |

*Primary Examiner*—Henry C. Yuen

[57] ABSTRACT

A flow control device is provided for use with a fan to prevent pressure excursions in a furnace or any other hardware equipment to which the fan is connected. The control device is connected in parallel relation with respect to the fan so that a recirculating flow path is formed between an outlet of the fan and an inlet thereof. This recirculating flow path controls the pressure differential produced by the fan. The control device includes duct work and a controlled element, preferably, a damper. In a furnace system, an induced draft fan is connected in series with a furnace and the controlled device is normally in a closed position in parallel with the induced draft fan. Upon the occurrence of one or more predetermined fault conditions, the controlled device modulates open to provide a circulating path through the induced draft fan and rapidly controls the pressure differential between the inlet and outlet of the fan. Since this pressure differential is maintained within a desirable range, the induced draft fan does not create too great a suction against the inner walls of the furnace.

4 Claims, 4 Drawing Figures

FAN FLOW CONTROL DEVICE

FIELD OF THE INVENTION

The present invention relates to a device for controlling the pressure differential produced by a fan and, in particular, to a device connected in parallel relation with respect to a fan for use in preventing large pressure excursions.

BACKGROUND ART

The need for a device to control the pressure differential in a fan stems from a furnace implosion problem that has existed for several years in the electric power utility industry. Although the present invention can be applied in solving that problem, its application is much broader and can be used anywhere it is necessary to rapidly control the pressure differential produced by a fan. As an example of its use, its application as a furnace implosion prevention device will be subsequently described. However, even this application is general, since it applies to any fossil fuel-fired furnace and is not limited to only those furnaces found in electric power plants. Many furnaces operate in a "balanced draft" manner. This means that the internal furnace pressures are maintained, in steady state only, at atmospheric pressure. This is accomplished by using two sets of fans, one set on the inlet and one set on the outlet of the furnace. A forced draft fan provides the air for combustion and provides the necessary pressure to force the air through the burners and into the furnace. The second set of fans, called induced draft fans, provides the suction necessary to pull the furnace gases or products of combustion through the remainder of the system and exhaust them to atmosphere.

With the advent of considerably larger balanced draft furnaces, and specifically, the recent addition of flue gas cleaning systems, larger induced draft fans have been devised which have greater suction capability and hence a greater potential for causing furnace implosions. The economic losses from structural damage attributable to the large negative pressure excursions that can occur and the accompanying loss of power generation can be extremely high.

Large negative pressure excursions in the furnace can occur for various reasons, for example, a plant operator may adjust the controls improperly, or a piece of equipment might fail. The most prevalent is a fuel trip. This is the rapid and complete stoppage of fuel to the furnace and, in itself, is a perfectly natural means of quickly shutting down the furnace under emergency conditions. When a rapid fuel trip occurs there is a rapid drop in temperature and pressure in the flue gas on the inside of the furnace. This drop in pressure will be aggravated by what happens in the fans themselves. The drop in pressure causes a reduction in the flue gas flow rate leaving the furnace. This is the same flow that the induced draft fans are handling. This reduction in flow rate increases the pressure differential that the induced draft fan is producing. In addition to this increased fan suction, another phenomenon is simultaneously occurring which compounds the above effects. Prior to the fuel trip, all of the fan pressure differential was being consumed by system friction. Following the trip, and once the flow reduction has occurred, the system friction drops to almost zero inasmuch as friction drop is proportional to the square of the flow. Hence, all of the fan pressure differential is available as suction on the furnace. The net result of all this is that the transient negative pressure excursion in the furnace can be quite high. Accordingly, one of the principle applications of the present invention is to eliminate or substantially reduce the potential hazard caused by large negative pressure excursions in a furnace.

PRIOR ART STATEMENT

The following known prior art patent references are submitted under the provisions of 37 C.F.R. 1.97–1.99:

U.S. Pat. No. 3,964,675 to Euchner, Jr. discloses an apparatus for limiting the creation of a vacuum in a furnace. An inlet damper is connected in series to a duct. Combustion and draft regulating controls are operably connected to the inlet damper. An induced draft fan is connected downstream of the inlet damper. The closing of the inlet damper prevents the creation of a large vacuum in the furnace.

U.S. Pat. No. 4,189,295 describes a control apparatus which controls flow cross-section of combustion gases as a function of the temperature of a non-diluted combustion gas. When the combustion gas is at a low temperature, bi-metallic elements control the cross-section to a relatively small magnitude. When the combustion gas is at a high temperature, the bi-metallic elements operate to provide a larger cross-section flow. This results in a reduction of the pressure drop in the combustion chamber and heat exchanger.

U.S. Pat. No. 2,303,894 to Olsen describes a control device for controlling the feeding of air and solid fuel to a furnace. A damper is connected to a duct for controlling the air into the furnace and an induced draft fan is also provided.

U.S. Pat. No. 2,847,952 to McDonald relates to a steam plant apparatus which adjusts spin vanes of a turbine as a function of boiler load.

DISCLOSURE OF THE INVENTION

In accordance with the present invention, a device for controlling the flow of gaseous fluid is provided in combination with a fan, such as an induced draft fan for the purpose of rapidly controlling the pressure differential produced by the fan. The device is joined in parallel to the fan with one end of the device connected to the inlet of the fan and the other end of the device connected to the outlet of the fan. This flow control device is normally closed. In an application relating to preventing furnace implosion, when too great a negative pressure is experienced in the furnace, the control device is opened to control the furnace pressure until pressure once again is above its acceptable limit. In other fan pressure control applications, some parameter other than furnace pressure could be used as a control signal and, likewise, the fan could control some other physical parameter. The opening of the control device provides a flow path from the fan outlet to the fan inlet. The creation of this flow path produces an increase in the fan flow rate. This, in turn, drastically reduces the pressure differential produced by the fan. The amount of pressure reduction can be controlled by how far open the control devices are allowed to go or by the physical size of the control device and its connecting duct work.

This invention provides numerous advantages over devices that are presently known. Unlike the devices that are placed in line or in series with a fan, this device is placed in parallel with the fan. The devices that are positioned in series have a number of drawbacks, including a relatively large size. Because such prior art devices are installed in series with the main fan duct work, they must be as large as that duct work so as not to interfere with normal system operation. Another drawback is the cost of the prior art devices. Since they are of a larger size, they are more expensive and require larger actuators and more support structure. A further drawback of devices placed in series is that these control devices must be fully open under normal system operation. Consequently, when a fault occurs that requires rapid corrective action, these control devices begin to close from a fully open condition. Flow will not be affected until these movable devices travel to less than about 30% open. More important, the phenomenon is such that when flow reduces to near zero, the friction drop from these control devices also approaches zero, thereby producing no effect. An additional unwanted effect of series-connected control devices is present because such devices operate normally open. Specifically, since the failure mode of such devices is the closed state, a furnace explosion, for example, could occur in the case of a closed control device being used in series with induced draft fans downstream of a furnace.

The present invention overcomes the foregoing disadvantages. The control device disclosed herein is of a relatively small size in comparison with the above-noted control devices placed in series with main duct work. Relatedly, because of the smaller size, the installation cost is much less. Furthermore, because of the smaller size, the control device of the present invention can respond more quickly. Significantly also, this device is normally closed and only a relatively small amount of opening is required to start to produce a relatively large flow path and thereby to immediately impact the pressure differential produced by the fan. Finally, the control device herein is located in parallel with a fan and its normal position is the closed state. As a consequence, even if one of these control devices should fail, so that it is continuously open, it has not restricted the flow path. At best, such a failure would require a cut-back in load, and, at worst, it would cause the furnace to trip off.

Additional advantages of the present invention will become readily apparent from the following discussion taken in conjunction with the accompanying drawings.

DETAILED DESCRIPTION OF THE PREFERRED EMBODIMENT

In accordance with the present invention, a control device 10 is provided to reduce pressure differential produced in a fan 12. The control device 10 and fan 12 together may be used with various pieces of hardware to minimize the occurrence of high pressure excursions, even though the following discussion is directed to a particular application of the control device 10 in a furnace system in which the fan 12 is an induced draft fan.

Figure 1:
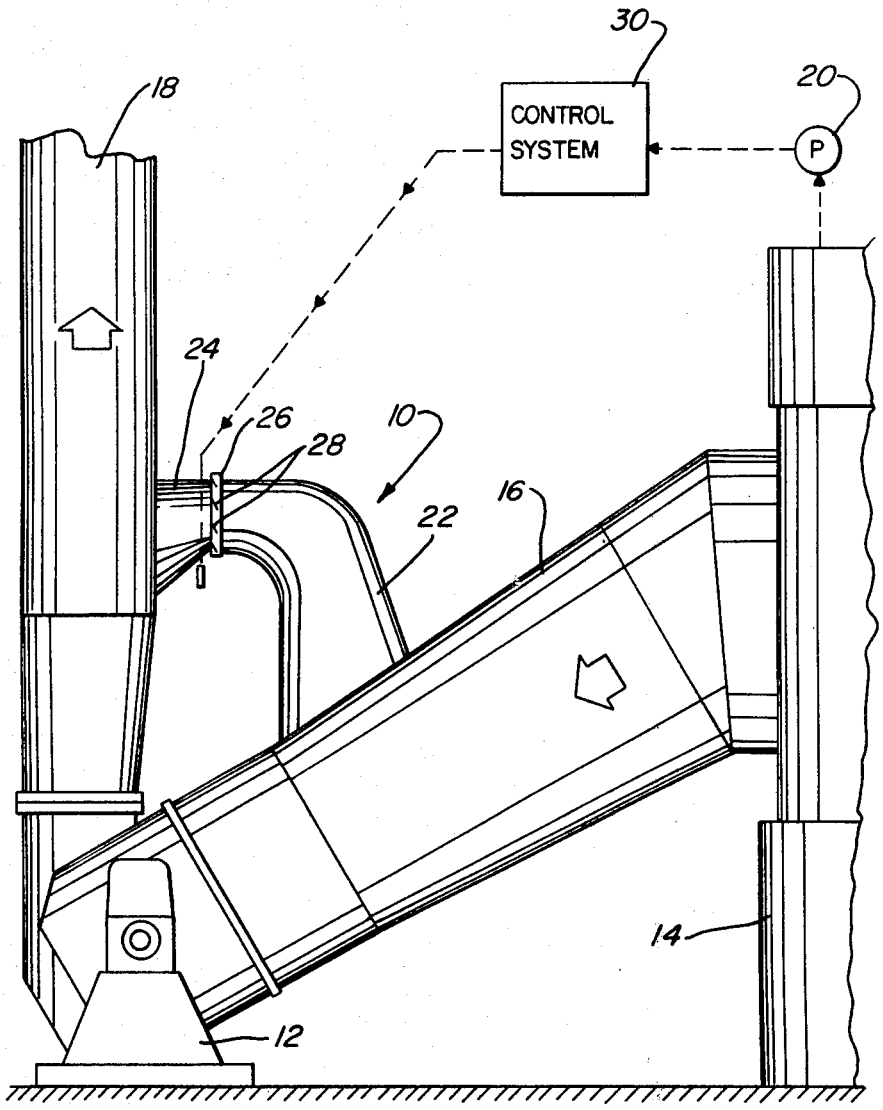
FIG. 1 is a side elevational view illustrating the control device of the present invention, attached in parallel to main duct work.

The furnace system includes a furnace or boiler 14 used, for example, in the electric power utility industry. An inlet duct 16 is connected in a conventional manner to the downstream side of the furnace 14. The inlet duct 16 carries flue gas from the furnace 14 to an inlet of the induced draft fan 12. The induced draft fan 12 is fixedly positioned in a common manner between the inlet duct 16 and an outlet duct 18 which receives the flue gas from an outlet of the induced draft fan 12. The induced draft fan 12 facilitates the flow of flue gas from the furnace 14 to the outlet duct 18. A pressure sensing device 20 is schematically depicted in FIG. 1 and is connected to the furnace 14 to monitor the pressure in the furnace 14.

Although not illustrated in the drawings, it is readily understood that the furnace system also typically includes a forced draft fan connected upstream of the furnace 14 as well as accompanying duct work positioned upstream of the furnace 14. The forced draft fan provides air for combustion in the furnace 14. It also provides the necessary pressure to force this air through burners and into the furnace 14. In addition, pollution control devices are frequently used in such a furnace system.

The control device 10 itself includes a first duct 22 connected to the inlet duct 16 and a second duct 24 connected to the outlet duct 18. These connections are provided in a well-known manner and are not significant to an understanding of the invention. The control device 10 further includes an element having a controlled opening and which is fastened between the first duct 22 and the second duct 24. This controlled element can be of any conventional design including, by way of example only, louvered, poppet, or slide-gate type of dampers. A louvered damper 26 having a number of pivotal vanes 28 offers the advantage of faster action and is therefore preferred. The first and second ducts 22, 24 taper to a reduced longitudinal cross-sectional area. At this reduced area, the damper 26 is fixedly attached by conventional means. This reduced cross-sectional area is about ¼ of the longitudinal cross-section of the outlet duct 18.

The significant feature of the present invention to be understood is that a control device 10 is connected in parallel relation with respect to the induced draft fan 12. In particular, first duct 22 of the control device 10 is connected adjacent the inlet of the induced draft fan 12 and the second duct 24 is connected adjacent the outlet of the induced draft fan 12. Because of this positioning of the control device 10, a controllable flow is provided from the outlet of the induced draft fan 12 to its inlet, the operation of which will be subsequently described.

In the preferred embodiment, the opening or closing of the vanes 28 of the control device 10 is determined by a control system 30 represented in block form in FIG. 1. The control system 30 is principally digital and analog circuitry in operation with the damper 26. The control system 30 monitors conditions, such as pressure within the furnace 14 or wherever the pressure is to be controlled and, depending upon the state of the conditions, adjusts the amount of opening of the damper 26. Regardless of the problem that might be causing a large negative pressure excursion, the control system 30 adjusts the damper 26 to correct the pressure excursion.

The specific design of the control system 30 depends upon the requirements of the particular piece of equipment in which pressure is being controlled, for example, the furnace 14. It is therefore readily discerned that, once the desired parameters to be controlled are defined, an appropriate control system 30 can be devised by those skilled in the art.

The functioning and utility of the control device 10 can best be explained by reference to the graphs provided by FIGS. 2 through 5. The damper 26 or any other desired controlled element is normally closed, and there is only leakage flow through the first duct 22 and the second duct 24. As discussed previously, however, one or more conditions may occur which result in the activation of the control device 10 or, more specifically, the opening of the damper 26.

Figure 2:
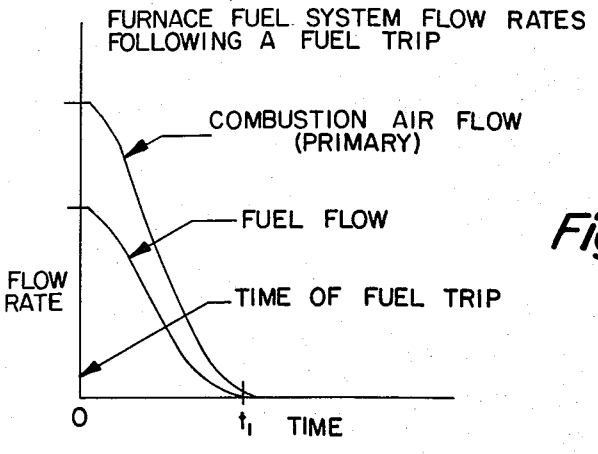
FIG. 2 is a graph of primary air and fuel flow rates vs. time following a master fuel trip.
Figure 3:
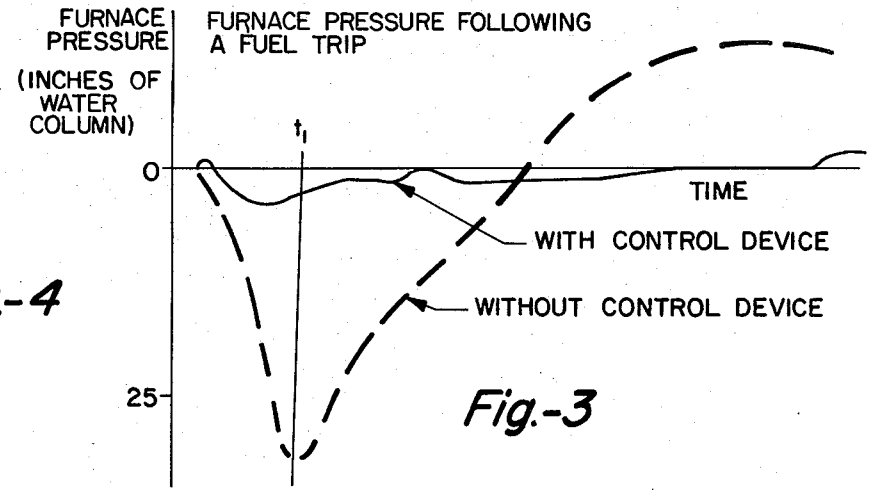
FIG. 3 is a graph of furnace pressure vs. time following a master fuel trip.
Figure 4:
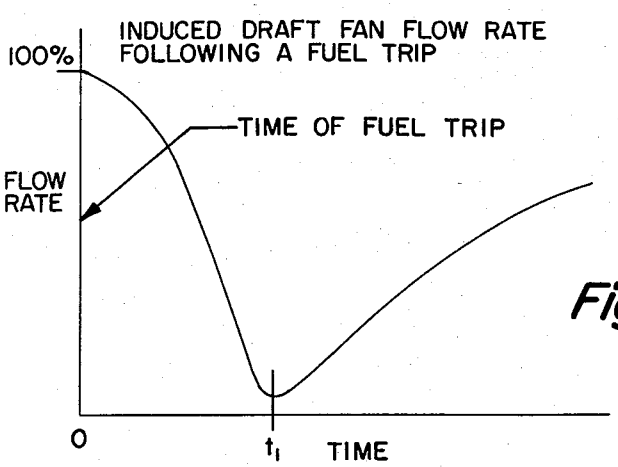
FIG. 4 is a graph of the percentage of flow rate through an induced draft fan vs. time following a master fuel trip without a control device of the present invention.

For the purposes of this explanation, assume that the induced draft fan 12 conveys flue gas from a furnace and that a master fuel trip (MFT) has occurred. An MFT causes the supply of fuel to furnace 14 to be rapidly discontinued. As illustrated in FIG. 2, upon the occurrence of a master fuel trip, the flow rate of fuel and primary air to the furnace 14 rapidly decreases to zero. Although the main source of energy to the furnace 14 has stopped, the heat transfer from the gas envelope within the furnace 14 to the colder furnace wall continues. This causes the rapid decrease in the temperature of the gases in the envelope. In systems which do not include the control device 10 disclosed herein, an accompanying large drop in pressure is also experienced inside the furnace 14, as represented by the dotted curve of FIG. 3. FIG. 3 shows the result of a dynamic mathematical model of an existing powder plant following a rapid fuel trip. As can be seen from the curve, the pressure in the furnace went down to −25 inches of water column. The particular furnace on which the mathematical model analysis was made was rated to withstand only −13 inches of water column. This pressure collapse within the furnace 14, as depicted in FIG. 3, is caused by many compounding factors. The suction created by the induced draft fan 12 is considered to be one of the most significant factors. As can also be seen in FIG. 3, the largest negative pressure experienced in the furnace 14 occurs at time $t_1$. The reduction in the draft in the furnace 14 causes a large and rapid decrease in the flow rate through the induced draft fan 12. The magnitude and rate of decay in flow through the induced draft fan 12 depends upon the rate of fuel flow decay. The more rapid the rate of fuel flow decay, the greater is the decay in flow rate through the induced draft fan 12. FIG. 4 represents fan flow rate as a function of time following the occurrence of a master fuel trip. This decrease in flow rate causes an increased pressure differential to be produced by the induced draft fan 12. This is represented by the direction of the arrows depicted in FIG. 5, i.e., this flow reduction causes the fan to "run back up on its curve". This, in turn, results in increased suction relative to the furnace 14. Without a mechanism for minimizing or elminating this increased suction, the considerable negative pressure is exerted against the inner walls of the furnace 14. If this exceeds the design limits, considerable structural damage can result.

Figure 5:
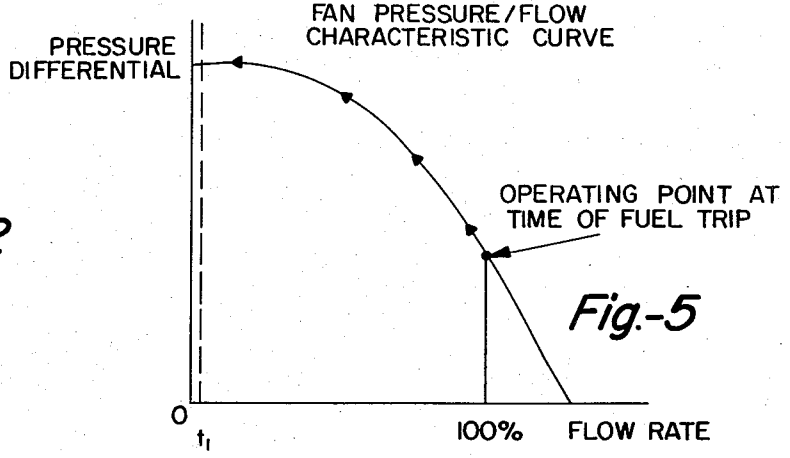
FIG. 5 is a graph of pressure differential vs. flow rate relating to a fan.

The control device 10 prevents the induced draft fan 12 from producing the large pressure differential. Specifically, when a master fuel trip signal occurs, it is sent through the control system 30. The control system 30 controls the magnitude of the opening of the damper or controlled element 26 of the control device 10. The opening of the damper 26 provides a recirculation path from the outlet of the induced draft fan 12 to the inlet thereof. This flow path increases the flow rate through the induced draft fan 12 and thereby actually causes the induced draft fan 12 pressure differential to decrease. This minimizes the negative pressure excursion within the furnace 14 and prevents the pressures therein from exceeding the design limits. With reference to FIG. 5, this recirculation flow causes the induced draft fan 12 to "ride down" on its head/flow characteristic curve. The mitigation of the negative pressure excursion in the furnace 14, by means of the control device 10, is depicted by the solid curve of FIG. 3. This curve is the result of an extensive mathematical modeling study that was carried out for the purpose of solving the furnace implosion problem at a power plant. As can be seen from the curve, the negative pressure excursion developed in the furnace, having the control device 10, is minimal.

Preferably also in a furnace protection system, utilizing the control device 10, a "kicker" circuit is provided as an anticipatory device. This circuit would activate immediately upon receipt of a master fuel trip, i.e., before furnace pressure has even been affected by fuel decay, and thereby starts to open the damper 26. As a consequence, the "kicker" circuit provides an immediate reaction to the master fuel trip signal and is not dependent upon a predetermined magnitude of fuel flow decay.

Although the foregoing description has been directed to the use of a control device 10 in parallel relation with respect to an induced draft fan 12, it is readily understood that the control device 10 can also be used with any fan, including forced draft and booster or scrubber fans. The primary feature of the control device 10 is its capability of reducing large pressure excursions in hardware systems using a fan by reducing the pressure differential produced in the fan.

Also, although FIG. 1 is illustrated with duct work and a furnace having a cylindrical configuration, it is understood that rectangular shaped duct work and furnace are commonly used and the present invention can be readily used with such configured hardware.

In view of the foregoing description of the preferred embodiment, it is readily discerned that a number of advantages of the present invention are provided. A control device is described for use with a fan which effectively prevents significant pressure excursions in a furnace or any other piece of hardware because a recirculating flow path is controllably provided. This path results in a rapid decrease in a pressure differential produced by the fan. The control device is relatively simple in construction and readily adapted to various desired existing systems. The cross-sectional area of the control device is considerably smaller than that of the cross-sectional area of the duct work to which the fan is connected in order to minimize the cost of the control device and yet provide a satisfactory recirculating path. The opening of the controlled element is also rapidly activated to facilitate the reduction of high pressure excursions. Further, the degree or amount of opening of the controlled element is controllable and normally depends upon the severity of the fault condition detected.

Although the present invention has been described with reference to a particular embodiment, it is readily understood that variations and modifications can be effected within the spirit and scope of this invention.

What is claimed is:

1. Apparatus for preventing an excessive loss of pressure of a gaseous fluid in a duct on the inlet side of a fan comprising:

a furnace having an outlet through which a gaseous fluid is discharge;

a fan having an inlet for receiving said gaseous fluid and an outlet for discharging said gaseous fluid;

a duct for connecting said outlet of said furnace and said inlet of said fan and for providing a passageway for said gaseous fluid from said furnace to said fan;

another duct for connecting said outlet of said fan to said duct for connecting said outlet of said furnace and said inlet of said fan and for providing a passageway for at least a portion of said gaseous fluid being discharged from said fan;

a louvered damper capable of movement between a fully closed position and a fully opened position for controlling the amount of gaseous fluid flowing through said duct from said outlet of said fan to said duct for connecting said furnace to said inlet of said fan; and wherein said damper is responsive to the pressure in said furnace.

2. Apparatus as in claim 1 wherein:

said fan is an induced draft fan.

3. Apparatus as in claim 1 wherein:

said louvered damper has a plurality of vanes.

4. Apparatus as in claim 1 wherein:

the cross-sectional area of said louvered damper is less than the cross-sectional area of any of said ducts.

* * * * *